US010349727B2

(12) United States Patent
Pactanac et al.

(10) Patent No.: US 10,349,727 B2
(45) Date of Patent: Jul. 16, 2019

(54) CABLE-TENSIONING SYSTEM STRAP

(71) Applicant: NIKE, Inc., Beaverton, OR (US)

(72) Inventors: Pierre A. Pactanac, Portland, OR (US); Elizabeth A. Kilgore, Portland, OR (US); Matthew C. Palmer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/877,905

(22) Filed: Jan. 23, 2018

(65) Prior Publication Data

US 2018/0146768 A1 May 31, 2018

Related U.S. Application Data

(63) Continuation of application No. 14/805,964, filed on Jul. 22, 2015, now Pat. No. 9,901,163.

(51) Int. Cl.

| | |
|---|---|
| ***A45F 3/14*** | (2006.01) |
| ***A45F 3/04*** | (2006.01) |
| ***A63B 55/00*** | (2015.01) |

(52) U.S. Cl.

CPC ..... *A45F 3/14* (2013.01); *A45F 3/04* (2013.01); *A63B 55/408* (2015.10); *A45F 2003/142* (2013.01)

(58) Field of Classification Search

CPC ..... A45F 3/14; A45F 2003/142; A45F 3/12; A45F 3/047; A45F 2003/122; A45F 3/04; A61F 5/028; A61F 2250/001; A61F 5/026

USPC ..... 224/257, 643, 264; 2/268

See application file for complete search history.

(56) References Cited

U.S. PATENT DOCUMENTS

| | | | | |
|---|---|---|---|---|
| 6,640,344 | B2 | 11/2003 | D'Addario et al. | |
| 2007/0084956 | A1* | 4/2007 | Chen | A43C 7/00 242/388.6 |
| 2010/0072091 | A1 | 3/2010 | Quartarone | |
| 2011/0284608 | A1 | 11/2011 | Staudecker et al. | |

(Continued)

FOREIGN PATENT DOCUMENTS

| | | | |
|---|---|---|---|
| CN | 1451337 | A | 10/2003 |
| CN | 200938919 | Y | 8/2007 |

(Continued)

OTHER PUBLICATIONS

International Searching Authority, International Search Report and Written Opinion for PCT Application No. PCT/US2016/043327, dated Oct. 27, 2016.

(Continued)

*Primary Examiner* — Nathan J Newhouse
*Assistant Examiner* — Matthew T Theis
(74) *Attorney, Agent, or Firm* — Honigman LLP; Matthew H. Szalach; Jonathan P. O'Brien

(57) ABSTRACT

A strap for a bag provides and includes a main body having a first end attached to a first attachment location of the bag and a second end attached to a second attachment location of the bag. The strap also includes a tension element that extends between the first end and the second end. The tension element is movable between a tightened state and a relaxed state. The tension element also applies a force on the first end and the second end in the tightened state to change the relative position of the first end and the second end.

22 Claims, 10 Drawing Sheets

(56) References Cited

U.S. PATENT DOCUMENTS

| | | | | |
|---|---|---|---|---|
| 2012/0012628 | A1* | 1/2012 | Just | A45C 13/02 224/578 |
| 2012/0037674 | A1* | 2/2012 | Crandall | A45F 3/12 224/257 |
| 2012/0241341 | A1 | 9/2012 | Harris et al. | |
| 2016/0353863 | A1* | 12/2016 | Wendler | A45F 3/02 |

FOREIGN PATENT DOCUMENTS

| | | | |
|---|---|---|---|
| EP | 1380227 | A2 | 1/2004 |
| GB | 2378936 | A | 2/2003 |

OTHER PUBLICATIONS

United States Patent and Trademark Office, Office Action for U.S. Appl. No. 14/805,964, dated Nov. 18, 2016.
United States Patent and Trademark Office, Office Action for U.S. Appl. No. 14/805,964, dated Jun. 2, 2017.
European Patent Office, Office Action for EP Application No. 16745357.0, dated Apr. 8, 2019.
China National Intellectual Property Administration, Notification of the First Office Action and Search Report for CN Application No. 201680052192.8, dated Apr. 29, 2019.

* cited by examiner

CABLE-TENSIONING SYSTEM STRAP

CROSS REFERENCE TO RELATED APPLICATION

This application is a continuation of U.S. patent application Ser. No. 14/805,964, filed Jul. 22, 2015, entitled Cable-Tensioning System Strap, the entire contents of which are incorporated herein by reference.

The present disclosure relates to a bag and more particularly to a bag having one or more releasably tensioned shoulder straps.

BACKGROUND

This section provides background information related to the present disclosure which is not necessarily prior art.

Bags such as equipment bags, backpacks, and duffel bags typically include a strap or other carry mechanism that facilitates carrying of the particular bag. Such straps are typically anchored at two locations and span at least a portion of the bag to provide an opening between the strap and a body of the bag. The opening allows a user to insert a portion of the user's body within the opening and between the strap and the bag body. For example, backpacks typically include a pair of straps that respectively form openings between a body of the backpack and the respective strap to allow shoulders of the user to engage inner surfaces of the straps in an effort to support the backpack adjacent to the user's back. A length of each strap is typically adjustable to control the size of each opening, thereby adjusting a position of the backpack on the user's back. For example, a shorter strap length results in a smaller opening as compared to a longer strap length which, in turn, results in the backpack residing at a higher position on the user's back.

While two or more straps are typically associated with a backpack, some equipment bags, such as golf bags, have recently incorporated a pair of straps to facilitate carrying of the golf bag. For example, golf bags may incorporate a pair of shoulder straps that allow the weight of the golf bag to be somewhat evenly distributed on each shoulder of a user in an effort to facilitate carrying of the golf bag. In order to minimize undue shoulder fatigue and soreness when transporting the golf bag, the golf bag must be properly positioned while supported on the user's shoulders. A proper position of the golf bag allows for the weight of the golf bag to be evenly distributed on the shoulders of the user while also restricting the golf bag from interfering with the legs of the user during walking movements. As with straps associated with a backpack, the length of the straps of a conventional golf bag are typically adjustable to provide a user with the ability to adjust a position of the golf bag relative to the user's body.

In view of the foregoing, conventional bags allow for adjustment of a carry mechanism (i.e., a strap) relative to a body of the bag. However, such adjustments are typically limited to a length adjustment. The shape and/or tension of the strap itself are not adjustable and, therefore, do not allow a user to tailor the shape or tension of the strap to fit the body of the particular user.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
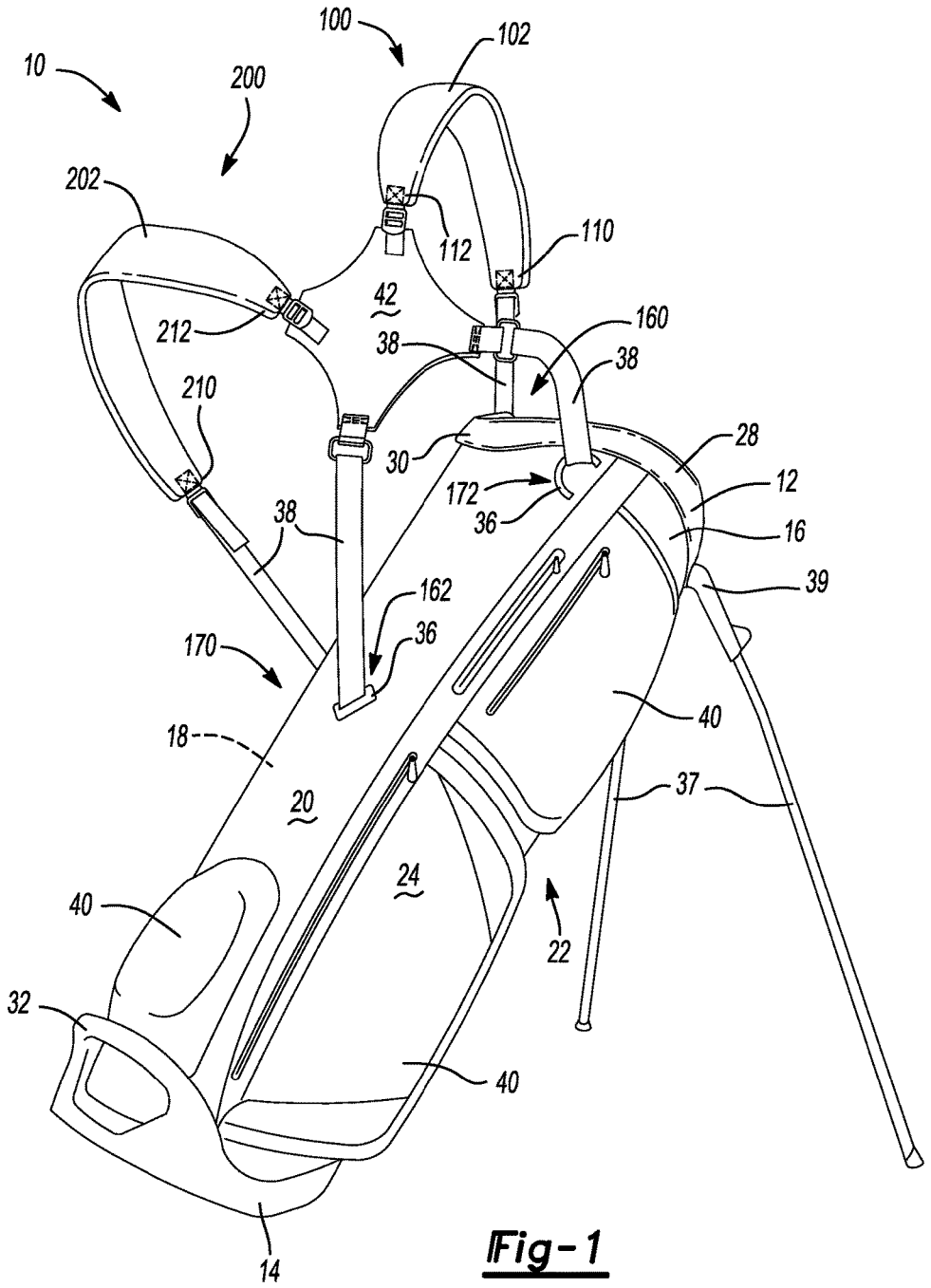
FIG. 1 is a perspective view of a golf bag having dual shoulder straps in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to the figures and in one aspect of the disclosure, a strap for a bag is provided and includes a main body having a first end attached to a first attachment location of the bag, a second end attached to a second attachment location of the bag, and a tension element that extends between the first end and the second end. The tension element is movable between a tightened state and a relaxed state. The tension element applies a force on the first end and the second end in the tightened state to change the relative position of the first end and the second end.

In some implementations, the tension element changes the relative position of the main body between the first end and the second end by changing a shape of the main body. In some examples, the strap also includes an actuation mechanism supported by the main body that moves the tension element between the tightened state and the relaxed state. The actuation mechanism may be rotatably supported by the main body and may include a locking mechanism that maintains the tension element in the tightened state in a first mode of operation and maintains the tension element in the relaxed state in a second mode of operation.

The main body may include a series of gaps disposed along a length of the main body. The gaps may permit the main body to flex when the tension element is moved from the relaxed state to the tightened state. In some examples, the gaps include a decreasing width in a direction extending from an edge of the main body toward a center of the main body. Optionally, the tension element may traverse the gaps between the first end and the second end of the main body. In operation, the gaps may be reduced when the tension element is moved from the relaxed state to the tightened state.

In some implementations, the main body includes at least one area of increased flexibility to allow the main body to take a different shape when the tension element is moved between the tightened state and the relaxed state. In some examples, the first end and the second end of the main body are simultaneously moved when the tension element is moved between the tightened state and the relaxed state.

In another aspect of the disclosure, a strap for a bag is provided and includes a main body having a first end attached to a first attachment location of the bag and a second end attached to a second attachment location of the bag. The strap includes a tension element that extends between the first end and the second end and is movable between a tightened state and a relaxed state. The tension element applies a force on the first end and the second end in the tightened state to change a shape of the main body.

The strap may also include an actuation mechanism that is supported by the main body and moves the tension element between the tightened state and the relaxed state. The actuation mechanism may be rotatably supported by the main body and may include a locking mechanism that maintains the tension element in the tightened state in a first mode of operation and maintains the tension element in the relaxed state in a second mode of operation.

In some configurations, the main body includes a first series of gaps and a second series of gaps disposed along a length of the main body. In these configurations, the first series of gaps and the second series of gaps permit the main body to flex when the tension element is moved from the relaxed state to the tightened state. The first series of gaps are disposed on an opposite side of the main body than the second series of gaps to allow the main body to be moved into the different shape when placed under tension.

The tension element may traverse the first series of gaps and the second series of gaps between the first end and the second end. The first series of gaps and the second series of gaps may be reduced when the tension element is moved from the relaxed state to the tightened state. In some examples, the first series of gaps and the second series of gaps include a decreasing width in a direction extending from an edge of the main body toward a center of the main body.

In some implementations, the main body includes at least one area of increased flexibility to allow the main body to take the different shape when the tension element is moved between the tightened state and the relaxed state. In some examples, the first end and the second end of the main body are simultaneously moved when the tension element is moved between the tightened state and the relaxed state.

Referring to FIG. 1, a golf bag 10 is provided and includes a first support member 12, a second support member 14, and a substantially tubular body 16. The golf bag 10 may define a length extending between the first support member 12 and the second support member 14 and may further include a front 20, a rear 22, and opposite sides 24 extending between the front 20 and the rear 22 to define corresponding panels of the golf bag 10 that extend through the length of the golf bag 10.

The body 16 may extend between the first support member 12 and the second support member 14 and may include interior surfaces that define an interior void 18 that receives and holds one or more golf clubs (not shown). A club opening 28 defined by the first support member 12 may provide access to the interior void 18. For example, the club opening 28 may receive a golf club to hold the golf club within the interior void 18 and facilitate entry and removal of the club from and to the interior void 18. In some examples, a portion of the golf clubs received within the interior void 18 may extend out of the interior void 18 and through the club opening 28 defined by the first support member 12. In some configurations, the first support member 12 includes a lip located around the periphery of the club opening 28 that supports a head portion (not shown) of one or more golf clubs received by the interior void 18. In these configurations, the lip may be formed from an abrasion-resistant material to prevent damaging the head portions of the golf clubs in contact therewith. Additionally or alternatively, the first support member 12 may define one or more dividers (none shown) extending across the club opening 28 to define at least two compartments to suitably arrange and organize the golf clubs received within the interior void 18.

The second support member 14 is disposed on an opposite end of the golf bag 10 than the first support member 12 and may include an inner surface and a ground-engaging surface disposed on an opposite side of the second support member 14. The inner surface may support handles (e.g., grips) of each golf club received by the interior void 18 through the club opening 28 defined by the first support member 12. The second support member 14 may be generally oriented to contact a ground surface when the golf bag 10 is not being carried and, therefore, may provide abrasion-resistance and frictional engagement with the ground surface 2. The second support member 14 may be formed from one or more materials that impart durability and wear-resistance, as well as enhance grip with the ground surface 2. For example, rubber may form at least a portion of the second support member 14.

The golf bag 10 includes one or more retractable legs 37 that selectively support the golf bag 10 in a partially upright position (FIG. 1) on the ground surface when the retractable legs 37 are in a deployed position. For example, each retractable leg 37 may include a proximal end attached to the golf bag 10 at an attachment location 39 disposed proximate to the rear 22 of the golf bag 10 and a distal end that engages the ground surface when the legs 37 are in the deployed position. The retractable legs 37 may move into a retracted position when the golf bag 10 is lifted off of the ground surface, thereby allowing the retractable legs 37 to be positioned adjacent to and substantially parallel with the rear 22 of the golf bag 10.

A grab handle 30 may be located at the front 20 of the golf bag 10 at a location proximate to the first support member 12 to allow the golf bag 10 be carried by a user. Additionally or alternatively, a lift handle 32 may be located at the front 20 of the golf bag 10 at a location proximate to the second support member 14 to allow a user to support the golf bag 10 at the second support member 14 when the bag 10 is carried. One or more accessory storage compartments 40 may be attached to the body 16 or formed therefrom. The one or more accessory storage compartments 40 may be used by a golfer to store golf-related items such as golf balls, tees, and towels, as well as personal items such as beverages, mobile phones, and shoes.

The golf bag 10 may include one or more shoulder straps 100, 200 attached to one or more anchor points 36 disposed on the body 16 via one or more fastening straps 38. The fastening straps 38 may provide the shoulder straps 100, 200 with a degree of movement relative to the body 16 to help facilitate placement of the shoulder straps 100, 200 over the shoulders of a golfer. In some examples, the lengths of the fastening straps 38 may be selectively increased or decreased to adjust an amount of separation between the shoulder straps 100, 200 and the body 16 of the golf bag 10.

The anchor points 36 and the fastening straps 38 may cooperate to provide one or more attachment locations 160, 162, 170, 172 for the shoulder straps 100, 200. For instance, the first shoulder strap 100 may include a main body 102 having a first end 110 attached to a first attachment location 160 of the golf bag 10 and a second end 112 attached to a second attachment location 162 of the golf bag 10 via the fastening straps 38. Likewise, the second shoulder strap 200 may include a main body 202 having a first end 210 attached to a third attachment location 170 of the golf bag 10 and a second end 212 attached to a fourth attachment location 172 of the bag 10 via the fastening straps 38. The golf bag 10 may also include a back pad 42 that attaches to at least one of the shoulder straps 100, 200 to enhance comfort for the golfer when transporting the golf bag 10. Further, the back pad 42 transmits loads from the second ends 112, 212 of the respective straps 100, 200 to the anchor points 36 via the straps 38.

Figure 2:
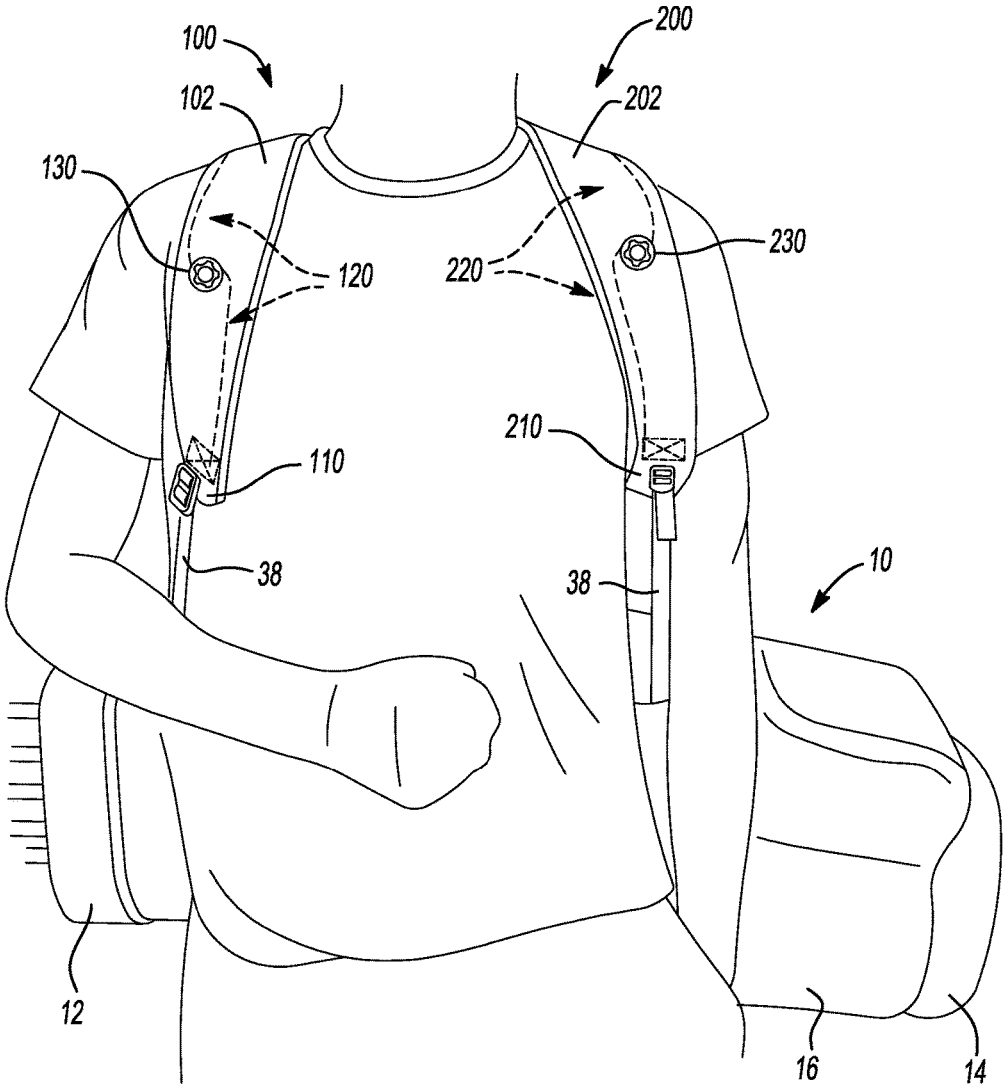
FIG. 2 is a perspective view of the golf bag of FIG. 1 showing the dual shoulder straps in a straight configuration while supporting the golf bag on shoulders of a user.
Figure 3:
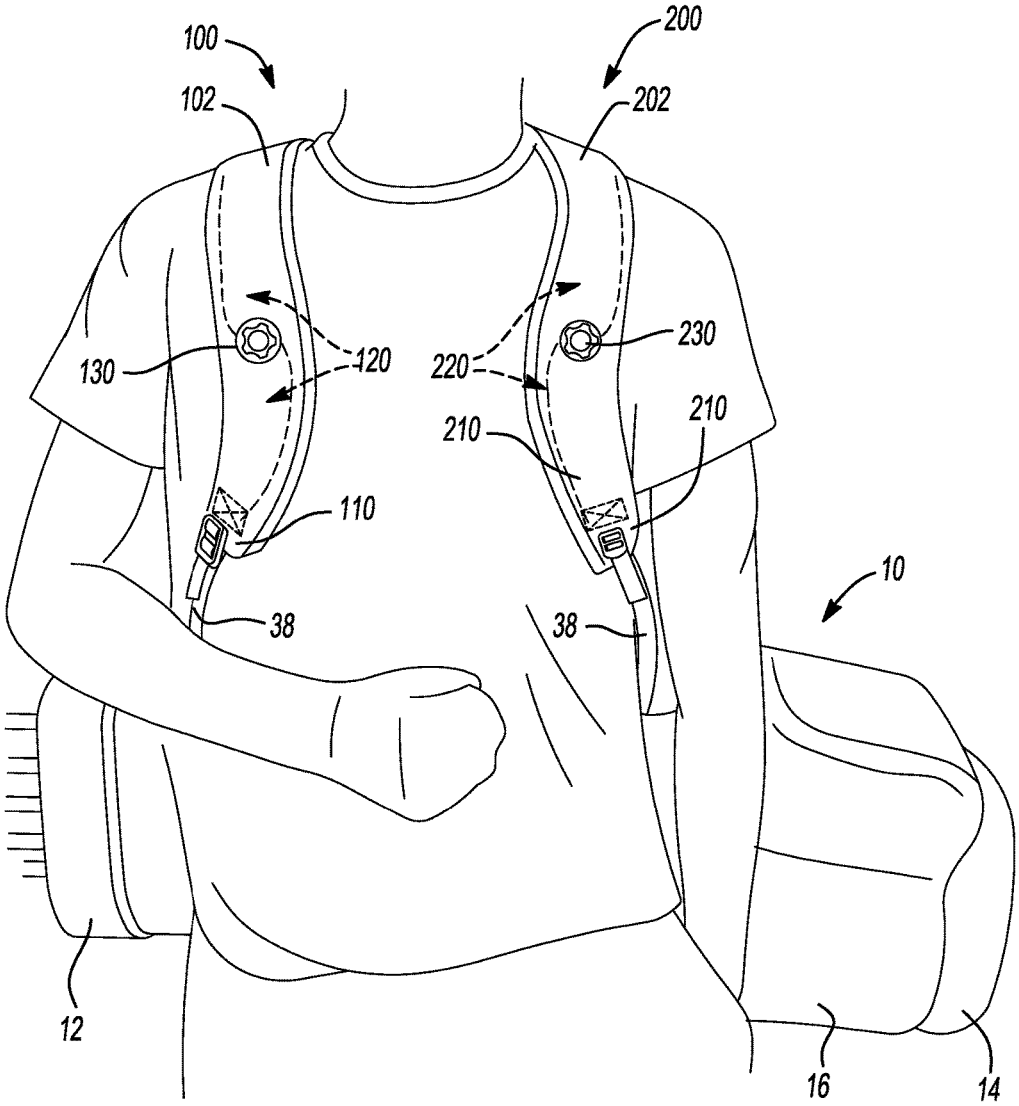
FIG. 3 is a perspective view of the golf bag of FIG. 1 showing the dual shoulder straps in a curved configuration while supporting the golf bag on shoulders of a user.

Referring to FIGS. 1-3, the first shoulder strap 100 and the second shoulder strap 200 may cooperate to support the golf bag 10 on corresponding shoulders of a user such as a golfer so that the golfer may transport the golf bag 10. For instance, the first shoulder strap 100 may correspond to a right shoulder strap configured to be supported by a right shoulder of the golfer and the second shoulder strap 200 may correspond to a left shoulder strap configured to be supported by a left shoulder of the golfer. At least one of the shoulder straps 100, 200 may include a respective tension element 120, 220 that extends between its respective first end 110, 210 and its respective second end 112, 212 and is movable between a tightened state and a relaxed state. FIG. 2 shows each of the tension elements 120, 220 in their relaxed state while the shoulder straps 100, 200 are supported on the shoulders of the golfer. In the relaxed state, the main bodies 102, 202 of the shoulder straps 100, 200 may include a substantially straight configuration between each first end 110, 210 and each second end 112, 212.

FIG. 3 shows each of the tension elements 120, 220 in their tightened state. In the tightened state, the tension element 120 applies a force on the first end 110 and on the second end 112 of the first strap 100 and the tension element 220 applies a force on the first end 210 and on the second end 220 of the second strap 200. The applied forces change the relative position of the first ends 110, 210 and the second ends 112, 212 and, as a result, change the position of the main bodies 102, 202 from the straight configuration (FIG. 2) to a curved configuration (FIG. 3). That is, the shape of the main body 102 changes as the tension element 120 of the first shoulder strap 100 changes the relative position of the first end 110 and the second end 112. Likewise, the shape of the main body 202 changes as the tension element 220 of the second shoulder strap 200 changes the relative position of the first end 210 and the second end 212. As with the main body 102 of the first shoulder strap 100, the shape of the main body 202 of the second shoulder strap 200 changes from the straight configuration to a curved configuration when the tension element 220 is in the tightened state.

As described, the tension elements 210, 220 place the corresponding shoulder straps 100, 200 under tension while being supported by the shoulders of the golfer and the golf bag 10 is being transported. As a result, the curved configurations allow the shoulder straps 100, 200 to tighten and grip around the shoulders of the golfer to thereby place the golf bag 10 under tension so that movement of the golf bag 10 relative to the body of the golfer is restricted while the golf bag 10 is being transported. The curved configurations of the main bodies 102, 202 may include an S-shaped configuration, a C-shaped configuration, or other curved configurations having a desirable shape that suitably places the shoulder straps 100, 200 under tension for transporting the golf bag 10. Further, such shapes may increase the comfort of the golfer when carrying the bag, as the golfer has the ability to independently adjust a shape of each strap 100, 200 such that a shape of each strap 100, 200 can be tailored to the specific shape of the golfer's body. For example, the first strap 100 may be adjusted to a partially curved configuration between the straight configuration shown in FIG. 2 and the fully curved configuration shown in FIG. 3 while the second strap 200 may be adjusted to the fully curved configuration shown in FIG. 3. Any adjustment between the straight configuration of FIG. 2 and the fully curved configuration of FIG. 3 is possible depending on the tension of the tension elements 210, 220.

An actuation mechanism 130 may be associated with each strap 100, 200 to adjust a tension in each tension element 210, 220 and, thus, a shape of each strap 100, 200. In one configuration, the actuation mechanism 130 is supported by the main body 102 of the first shoulder strap 100 and provides a locking mechanism 144 (FIG. 12) that maintains the tension element 120 in the tightened state in a first mode of operation and maintains the tension element 120 in the relaxed state in a second mode of operation. Similarly, the second shoulder strap 200 may also include an actuation mechanism 230 and locking mechanism 144 supported by its main body 202 that maintains the tension element 220 in the tightened state in a first mode of operation and maintains the tension element 220 in the relaxed state in a second mode of operation. As will be described below, the actuation mechanisms 130, 230 are independently adjustable to allow a user to adjust a configuration of each strap 100, 200 independently from one another.

Figure 4:
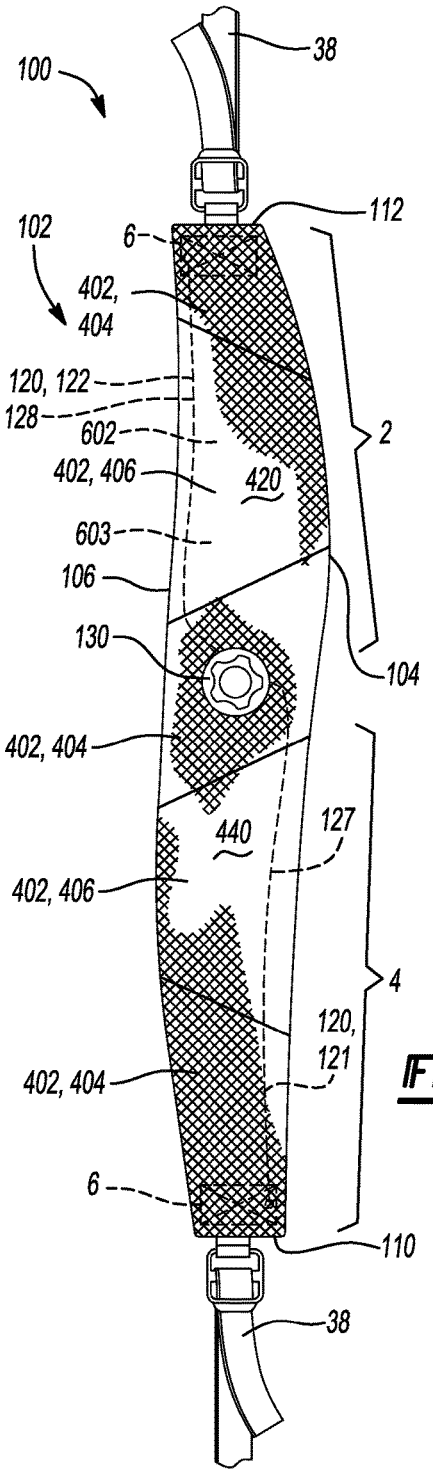
FIG. 4 is a front view of one of the shoulder straps of FIG. 1 having a straight configuration.
Figure 5:
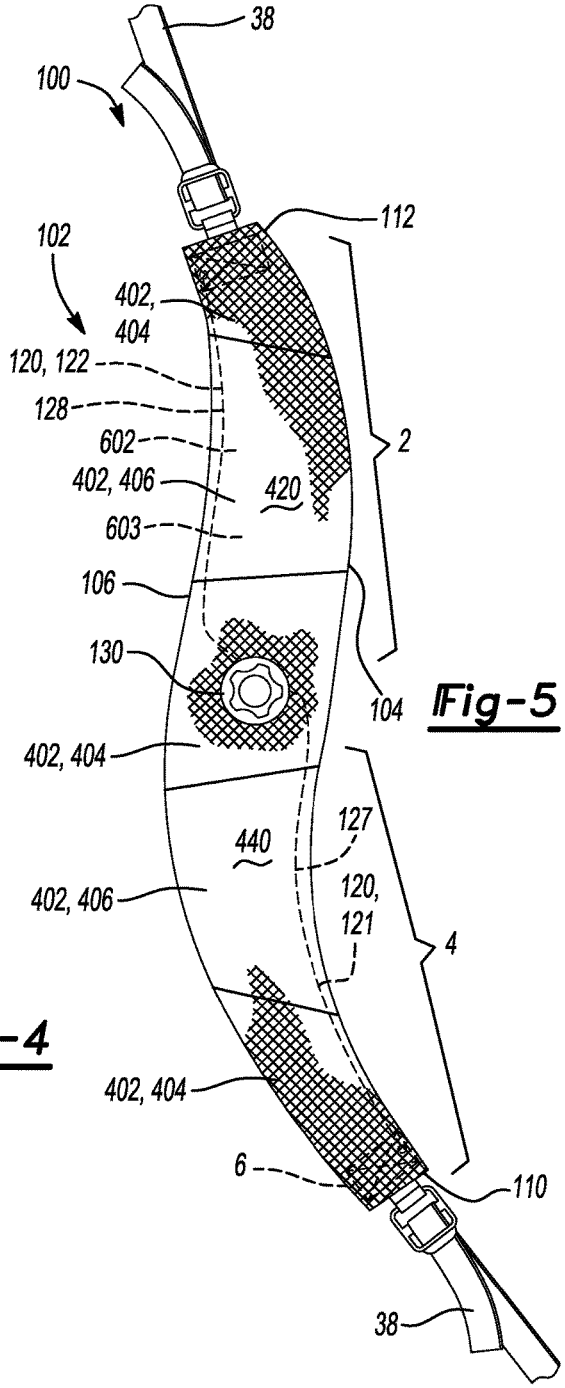
FIG. 5 is a front view of one of the shoulder straps of FIG. 1 having a curved configuration.

FIG. 4 provides a front view of the first shoulder strap 100 (e.g., right shoulder strap) of FIG. 1 having a straight configuration when the tension element 120 is in the relaxed state. Conversely, FIG. 5 provides a front view of the first shoulder strap 100 having a curved or S-shaped configuration when the tension element 120 is in the tightened state. As shown in FIGS. 2 and 3, the straps 100, 200 are mirror images of one another but are otherwise identical. Accordingly, a detailed description of the second shoulder strap 200 and associated actuation mechanism 230 is foregone.

The main body 102 defines a length extending between the first end 110 and the second end 112 and includes an inner edge 104 and an outer edge 106 extending between the first end 110 and the second end 112 to define a perimeter of the main body 102. The inner edge 104 may be disposed closer to the center of the golfer's body than the outer edge 106 when the shoulder strap 100 is placed on the shoulder (e.g., right shoulder) of the golfer. In some configurations, the actuation mechanism 130 is disposed at a midpoint along the length of the main body 102, as shown in FIGS. 4 and 5.

The main body 102 may define an upper portion 2 disposed between the second end 112 and the actuation mechanism 130 and a lower portion 4 disposed between the first end 110 and the actuation mechanisms 130. The tension element 120 may include a first portion 121 associated with the lower portion 4 of the main body 102 and a second portion 122 associated with the upper portion 2 of the main body 102. In some examples, the first portion 121 corresponds to a first tensioning cable and the second portion 122 corresponds a second tensioning cable separate from the first cable 121.

The upper portion 2 may include an upper flexion region 420 and the lower portion 2 may include a lower flexion region 440. The upper flexion region 420 and the lower flexion region 440 may cooperate to enhance the ability of the main body 102 to flex, bend, or otherwise change its shape, when the tension element 120 is in the tightened state. For example, FIG. 5 shows the upper flexion region 420 allowing the inner edge 104 at the upper portion 2 to flex away from the center of the main body 102 as the second end 112 is pulled by the second portion 122 of the tension element 120 toward the actuation mechanism 130. Similarly, the lower flexion region 440 allows the inner edge 104 at the lower portion 4 to flex toward the center of the main body 102 as the first end 110 is pulled by the first portion 121 of the tension element 120 toward the actuation mechanism 130. Thus, the first portion 121 and the second portion 122 are configured to pull their associated ends 110, 112 toward the actuation mechanism 130 when the tension element 120 is in the tightened state such that the first end 110 and the second end 112 converge toward one another. The upper flexion region 420 may also allow the outer edge 106 at the upper portion 2 to flex toward the center of the main body 102 and the lower flexion region 440 may also allow the outer edge 106 at the lower portion 4 to flex away from the center of the main body 102 as the first end 110 and the second end 112 are pulled by their associated portions 121, 122 toward the actuation mechanism 130. Accordingly, the view of FIG. 5 shows the main body 102 changing its shape by flexing about the upper flexion region 420 and the lower flexion region 440 to attain the curved or S-shaped configuration.

The main body 102 may be defined by a core 602 extending along the length of the main body 102 and having a front surface and a shoulder-engaging surface disposed on an opposite side of the core 602 than the front surface. In some implementations, a core cover 603 is disposed on the front surface of the core 602 and includes substantially the same shape as the core 602. The core 602 may be formed from one or more polymer foam materials or other materials suitable to provide a degree of cushioning for the shoulder while transporting the golf bag 10. As described in greater detail below and with reference to FIGS. 6-11, the core 602 may include a series of gaps 1010, 1020 disposed along the length of the main body 102. The gaps 1010, 1020 may be associated with opposite edges 104, 106 of the main body 102 to provide at least one of the upper flexion region 420 and the lower flexion region 440 with the ability to flex, bend, or otherwise change its shape, when the tension element 120 is in the tightened state. Namely, the first series of gaps 1010 may be associated with the lower portion 4 of the main body 102 to provide a degree of flexibility to the lower flexion region 440 and the second series of gaps 1020 may be associated with the upper portion 2 of the main body 102 to provide a degree of flexibility to the upper flexion region 420. In operation, the series of gaps 1010, 1020 cooperate to facilitate bending and flexing of the core 602 of the main body 102 to allow the main body 102 to change its shape when the tension element 120 is moved between the relaxed state and the tightened state.

With continued reference to FIGS. 4 and 5, a cover 402 may at least partially enclose the core 602. For example, the present disclosure depicts the cover 402 as a layer that covers and secures to the front surface of the core 602. In other configurations, however, the cover 402 may correspond to a sleeve or casing that encloses the front surface and the shoulder-engaging surface of the core 602. The cover 402 may provide a level of protection for the core 602 and may be formed from one or more materials that impart properties of durability, wear-resistance, air-permeability, and flexibility during use of the shoulder strap 100. For instance, the cover 402 may be formed from fabric materials such as nylon or mesh. The cover 402 may be secured to the core 602 via stitching, adhesive, and/or other mechanical fasteners.

In some implementations, the cover 402 includes at least one area of increased flexibility to allow the main body 102 to take a different shape when the tension element 120 is moved between the relaxed state (FIG. 4) and the tightened state (FIG. 5). For example, the cover 402 may include at least one portion formed by one or more materials that impart increased flexibility to the cover 402 and at least one portion formed by one or more materials that impart increased durability and/or rigidity to the main body 102. In some examples, the cover 402 includes a flexible portion 406 disposed within both the upper flexion region 420 and the lower flexion region 440. The flexible portion 406 provides increased flexibility to allow the cover 402 to conform to the different shapes taken by the core 602 of the main body 102 when the tension element 120 is moved between the relaxed state (FIG. 4) and the tightened state (FIG. 5). The flexible portion 406 of the cover 402 may be formed from one or more elastomeric materials that provide 2-way or 4-way stretch within each of the flexion regions 420, 440. For instance, the elastomeric materials may include polyester-polyurethane copolymers. In some examples, the cover 402 also includes a durable portion 404 disposed adjacent to each of the ends 110, 112 of the main body 102 and also between the flexion regions 420, 440 proximate to the actuation mechanism 130. The durable portion 404 may impart durability and rigidity to the cover 402 in areas not susceptible to bending or flexing when the core 602 of the main body 102 takes different shapes. The materials associated with the durable portion 404 and the flexible portion 406 may therefore be different materials having different material properties.

The fastening straps 38 associated with the first attachment location 160 (FIGS. 1-3) and the second attachment location 162 (FIGS. 1-3) may be secured to the main body 102 via stitching 6 at locations proximate to the ends 110, 112 of the main body 102. For example, the fastening straps 38 may be secured to either or both of the core 602 and the cover 402. In some examples, the stitching 6 may be additionally or alternatively used to secure at least a portion of the tension element 120 to the core 602 and/or the cover 402, as will be described below.

Figure 6:
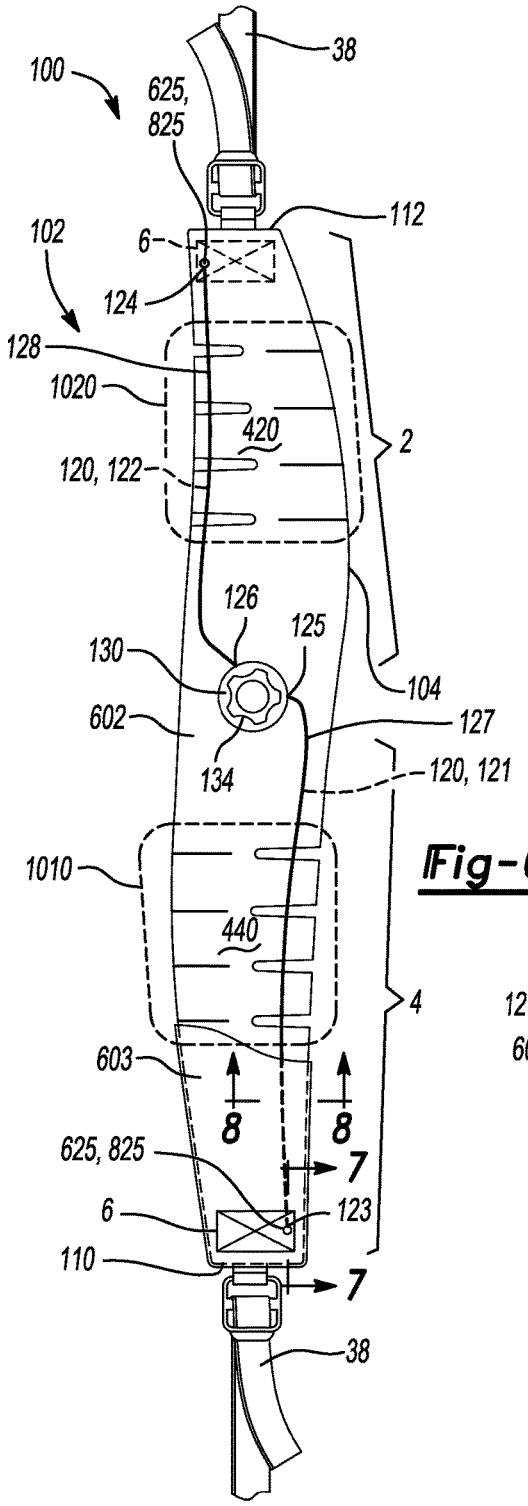
FIG. 6 is a front view of one of the shoulder straps of FIG. 1 in a straight configuration and with part of a cover removed to show a core and a tension element in a relaxed state.
Figure 9:
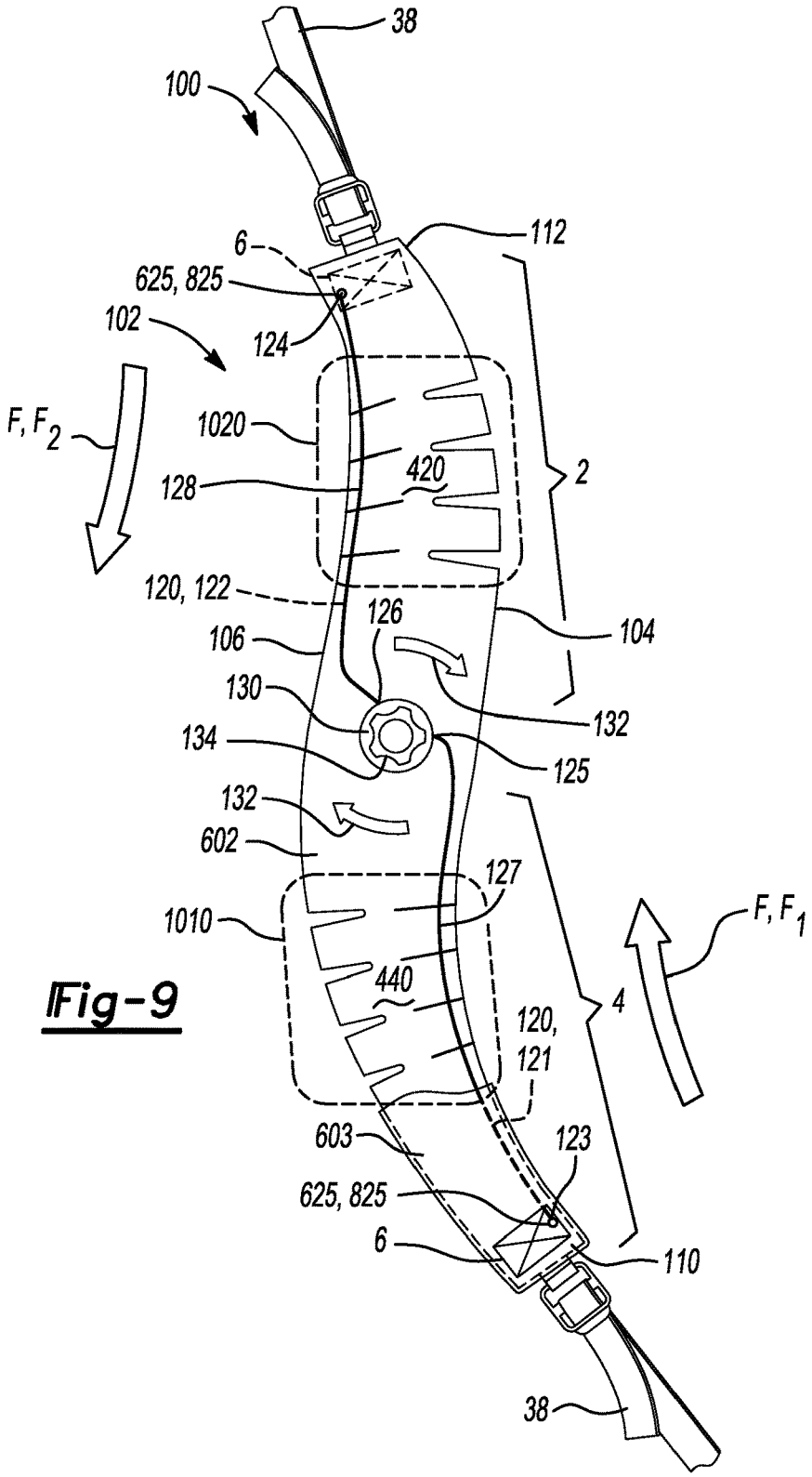
FIG. 9 is a front view of one of the shoulder straps of FIG. 1 in a curved configuration and showing a core and a tension element in a tightened state.

FIGS. 6 and 9 provide a front view of the first shoulder strap 100 having the cover 402 removed from the main body 102 to expose the core 602, the core cover 603, and the tension element 120. FIG. 6 shows the first shoulder strap 100 having the straight configuration when the tension element 120 is in the relaxed state and FIG. 9 shows the first shoulder strap 100 having the curved or S-shaped configuration when the tension element 120 is in the tightened state. The core cover 603 includes substantially the same shape as the core 602 and extends along the length of the main body 102 between the first end 110 and the second end 112. The views of FIGS. 6 and 9 show a portion of the core cover 603 removed to expose features that are disposed between the core 602 and the cover layer 603.

The first portion 121 (e.g., first tensioning cable) of the tension element 120 may define a length that extends between a proximal end 123 attached proximate to the first end 110 of the main body 102 and a distal end 125 received by and attached to the actuation mechanism 130. Similarly, the second portion 122 (e.g., second tensioning cable) of the tension element 120 may define a length that extends between a proximal end 124 attached proximate to the second end 112 of the main body 102 and a distal end 126 received by and attached to the actuation mechanism 130. In some examples, the proximal ends 123, 124 are secured to the core 602 of the main body 102 by the stitching 6 used to secure the fastening straps 38 to the core 602.

The first portion 121 and the second portion 122 of the tension element 120 may be substantially inelastic and formed from a wide variety of polymeric or metal materials or combinations thereof, which exhibit sufficient axial strength and bendability when the tension element 120 is in the tightened state. For example, any of a wide variety of solid-core wires, solid-core polymers, or multi-filament wires or polymers, which may be woven, braided, twisted or otherwise oriented, may be used. A solid or multi-filament metal core may be provided with a polymeric coating to reduce friction with the core 602 and/or the cover 402 to prevent damage to the core 602 and/or cover 402 during use. For example, at least one of the portions 121, 122 may include a stranded cable formed from stainless steel that is coated with a lubricous material, such as nylon or other similar material, to reduce friction with the core 602 and the cover layer 402.

In some implementations, the first portion 121 of the tension element 120 is enclosed by a first guide member 127. The second portion 122 of the tension element 120 may optionally be enclosed by a second guide member 128. Each guide member 127, 128 may include a tube-shaped configuration having an inside diameter larger than the outside diameter of the portions 121, 122 of the tension element 120 to facilitate sliding of the portions 121, 122 therethrough and relative to the core 602 and the core cover 603. The guide members 127, 128 may be fastened to the core 602 and/or the core cover 603 of the main body 102 by the stitching 6 used to secure the fastening straps 38 to the core 602 and/or via a suitable adhesive.

The tension element 120 may traverse the first series of gaps 1010 and the second series of gaps 1020 and may extend between the first end 110 and the second end 112 of the main body 102. For instance, the first portion 121 may traverse the first series of gaps 1010 along the inner edge 104 of the main body 102 and the second portion 122 may traverse the second series of gaps 1020 along the outer edge 106 of the main body 102. Positioning the first portion 121 and the second portion 122 in the foregoing manner relative to the gaps 1010, 1020 allows the relative position of the first end 110 and the second end 112 of the main body 102 to change when the tension element 120 is moved between the relaxed state and the tightened state. As described, changing the relative position of the first end 110 and the second end 112 likewise changes the shape of the main body 102 (i.e., between the straight configuration and the curved or S-shaped configuration). While the gaps 1010, 1020 are described and shown as being disposed on opposite sides of the core 602, the gaps 1010, 1020 could alternatively be disposed on the same side of the core 602. In such a configuration, the first portion 121 and the second portion 122 of the tension element 120 would traverse the gaps 1010, 1020 along the same edge of the core 602 (i.e., along one of the inner edge 104 and the outer edge 106) such that the main body 102 is movable between a substantially straight configuration when the tension element 120 is in the relaxed state and a substantially C-shaped configuration when the tension element 120 is in the tightened state.

In some implementations, recesses 625 are formed in the core 602 at locations proximate to the first end 110 and the second end 112 of the main body 102. A respective retaining ball 825 disposed at each of the proximal ends 123, 124 of the respective portions 121, 122 of the tension element 120 may be sized and shaped to fit within corresponding ones of the recesses 625. For example, the recesses 625 may include a shape that matingly receives the retaining balls 825 of the proximal ends 123, 124. The recesses 625 and the retaining balls 825 may facilitate attachment of the proximal ends 123, 124 of the respective portions 121, 122 to the core 602, thereby fixing the ends 123, 124 for movement with the core 602. Fixing the ends 123, 124 for movement with the core 602 causes the ends 110, 112 to be pulled toward the actuation mechanism 130 when a force F (FIG. 9) is applied on each end 110, 112 of the main body 102 by the actuation mechanism 130.

Figure 7:
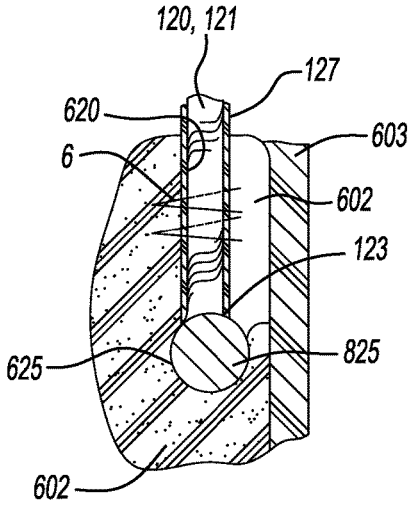
FIG. 7 is a cross-sectional view taken along line 7-7 of FIG. 6 showing a portion of the tension element of FIG. 6 secured to the core at one end.

Referring to FIG. 7, a cross-sectional view taken along line 7-7 of FIG. 6 shows the retaining ball 825 associated with the first portion 121 received by the recess 625 formed in the core 602 proximate to the first end 110. The retaining ball 825 may frictionally engage within the recess 625 to prevent the first portion 121 of the tension element 120 from moving relative to the core 206 when a first force $F_1$ (FIG. 9) is applied on the first end 110 of the main body 102. Additionally or alternatively, stitching 6 may assist to secure one or more portions of the tension element 120 to the core 602 proximate to the retaining ball 825. While not specifically illustrated, the retaining ball 825 of the second portion 122 may be secured to the core 602 proximate to the second end 112 in an identical manner.

With continued reference to FIG. 7, the core 602 is shown as including a channel 620 disposed along the length of the core 602 that receives the length of the first guide member 127 and the first portion 121 of the tension element 120. While not shown in the view of FIG. 7, the channel 620 also receives the length of the second guide member 128 and the second portion 122 of the tension element 120 in an identical fashion. The channel 620 may correspond to a groove formed into the front surface of the core 602 that includes a depth occupied by at least a portion of the thicknesses of the portions 121, 122 of the tension element 120 as well as the thicknesses of the guide members 127, 128 enclosing the portions 121, 122. The guide members 127, 128 may be disposed within the channel 620 and may facilitate movement of the portions 121, 122 therethrough as the tension element 120 moves between the tightened state and the relaxed state. In so doing, the guide members 127, 128 may be fixed for relative movement with the channel 620 to allow the portions 121, 122 of the tension element 120 to slide relative to the core 602 while concurrently preventing the portions 121, 122 from laterally moving relative to the core 602 when the first force $F_1$ (FIG. 9) is applied on the first end 110 of the main body 102 and a second force $F_2$ (FIG. 9) is applied on the second end 112 of the main body 102. Preventing lateral movement of the tension elements 120 relative to the core 602 when the tension element 120 is under tension ensures that the forces exerted on the tension element 120 via the actuation mechanism 130 will be properly transmitted to the ends 110, 112 and will result in movement of the core 602 from the straight configuration (FIG. 6) to the curved configuration (FIG. 9).

Figure 8:
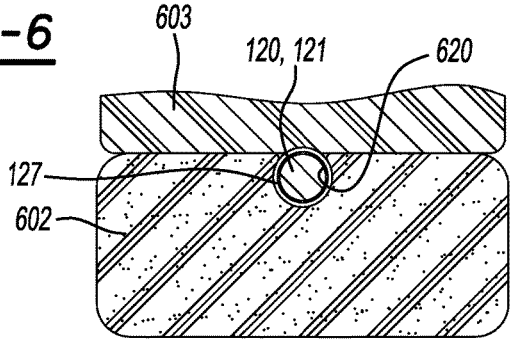
FIG. 8 is a cross-sectional view taken along line 8-8 of FIG. 6 showing a portion of the tension element of FIG. 6 received within a channel formed in the core.

FIG. 8 provides a cross-sectional view taken along line 8-8 of FIG. 6 showing the channel 620 formed in the core 602 and receiving the first guide member 127 enclosing the first portion 121 of the tension element 120 in a substantially coaxial relationship. In some examples, the guide members 127, 128 are lined or coated with a low-friction material, such as a lubricous polymer, that facilitates movement of the portions 121, 122 of the tension element 120 relative to and within the guide members 127, 128. In some examples, at least one of the guide members 127, 128 is omitted and the channel 620 is lined with a substantially rigid material and/or may be coated with a lubricous coating to reduce friction between the portions 121, 122 of the tension element 120 and the channel 120. In these examples, the substantially rigid material may impart a degree of rigidity to the channel 620 relative to the core 602 to prevent bending and kinking of the channel 620 and/or the portions 121, 122 of the tension element 120 within the channel 620 as the portions 121, 122 are placed under tension by the actuation mechanism 130.

Referring to FIG. 9, the tension element 120 applies the force F on the first end 110 and the second end 112 of the main body 102 in the tightened state to change the relative position of the first end 110 and the second end 112. More specifically, the first portion 121 of the tension element 120 applies the first force $F_1$ on the first end 110 when the first portion 121 is tightened by the actuation mechanism 130 and the second portion 122 of the tension element 120 applies the second force $F_2$ on the second end 112 when the second portion 121 is tightened by the actuation mechanism 130. The directions of the applied first force $F_1$ and the second force $F_2$ substantially oppose one another.

The views of FIGS. 6 and 9 show the actuation mechanism 130 as being supported by the main body 102 between the first end 110 and the second end 112. The actuation mechanism 130 selectively applies the first force $F_1$ and the second force $F_2$ on the first end 110 and the second end 112, respectively, to move the tension element 120 between the relaxed state (FIG. 6) and the tightened state (FIG. 9).

Figure 12:
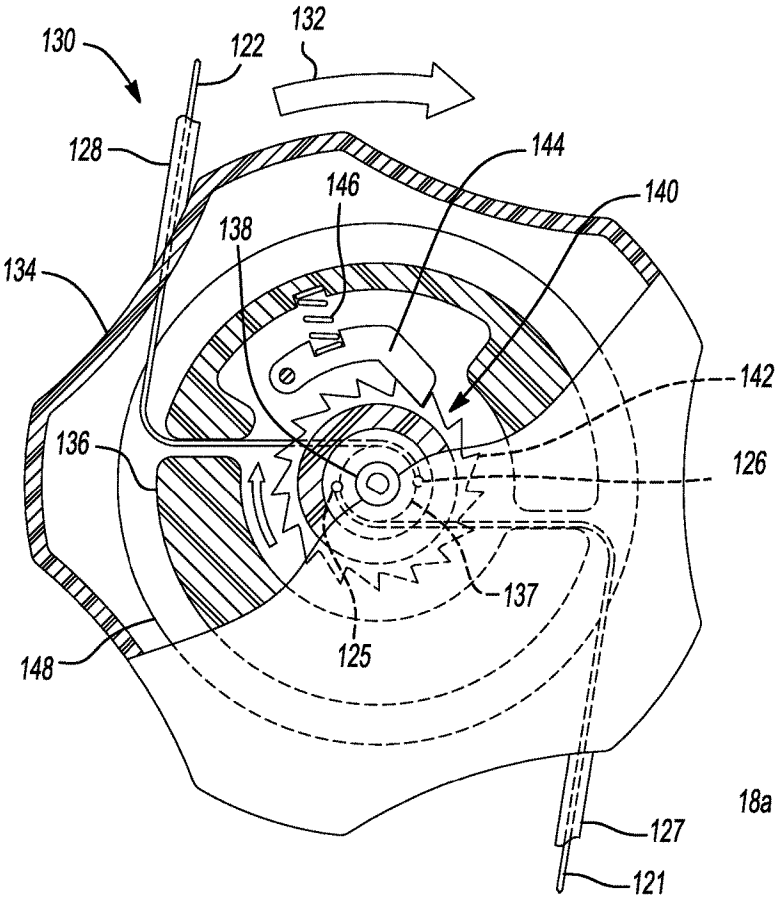
FIG. 12 is a schematic view of an actuation mechanism that selectively moves a tension element of the shoulder straps of FIG. 1 between a tightened state and a relaxed state.

The actuation mechanism 130 may be rotatably supported by the main body 102 with the distal ends 125, 126 of the tension element 120 attached to the actuation mechanism 130 from opposite directions. In some examples, the actuation mechanism 130 may be rotated relative to the main body 102 in a clockwise direction 132 relative to the view shown in FIG. 9 to increase the tension of each portion 121, 122 of the tension element 120. In these examples, the actuation mechanism 130 may increase the tension of the portions 121, 122 by retracting the portions 121, 122 attached thereto at their respective distal ends 125, 126 around a spool 137 (FIG. 12). As slack in the portions 121, 122 is eliminated, the portions 121, 122 of the tension element 120 apply a force on the respective ends 110, 112 of the main body 102 to move the ends 110, 112 toward the actuation mechanism 130. Movement of the ends 110, 112 toward the actuation mechanism 130 causes the core 602 and, thus, the main body 102 to take the S-shaped configuration. The actuation mechanism 130 may allow the portions 121, 122 to be tightened in increments, thereby resulting in the ends 110, 112 of the main body 102 to be increasingly pulled toward the actuation mechanism 130.

In some examples, the actuation mechanism 130 may include a control mechanism such as a knob 134 that can be manipulated (e.g., rotated in the clockwise direction 132) to simultaneously retract the portions 121, 122 of the tension element 120 into the actuation member 130. In these examples, retracting the first portion 121 and the second portion 122 decreases the effective length of each portion 121, 122 and, as a result, applies a force $F_1$, $F_2$ on each end 110, 112 of the main body 102, thereby drawings to ends 110, 112 toward one another. The applied forces $F_1$, $F_2$ pull each end 110, 112 of the main body 102 toward the actuation mechanism 130 and, as a result, causes the main body 102 to move from the straight configuration (FIG. 6) to the curved configuration (FIG. 9). That is, the ends 110, 112 of the main body 102 converge toward one another when the actuation mechanism 130 applies the forces $F_1$, $F_2$ via the portions 121, 122 of the tension member 120. As will be described, the gaps 1010, 1020 enhance the ability of the main body 102 to flex, bend, or otherwise change its shape at the flexion regions 440, 420, as the first end 110 and the second end 112 of the main body 102 are pulled in the foregoing manner.

With continued reference to FIGS. 6 and 9, the location and spacing of the series of gaps 1010, 1020 disposed along the length of the core 602, together with the placement of the portions 121, 122 of the tension element 120 disposed along the length of the core 602, may cooperate to attain the substantially S-shaped configuration of the main body 102 when the tension element 120 is in the tightened state. In other configurations, the first portion 121 of the tension element 120 associated with the lower portion 4 of the main body may be positioned along the outer edge 106 of the main body 102 to attain a substantially C-Shaped configuration when the tension element 120 is in the tightened state. In some implementations, the tension element 120 only includes one of the portions 121, 122 and only pulls one of the ends 110, 112 when tightened. In such a configuration, the actuation mechanism 130 may be moved proximate to one of the ends 110, 112 rather than being substantially centrally located on the main body 102, as shown in the figures.

Figure 10:
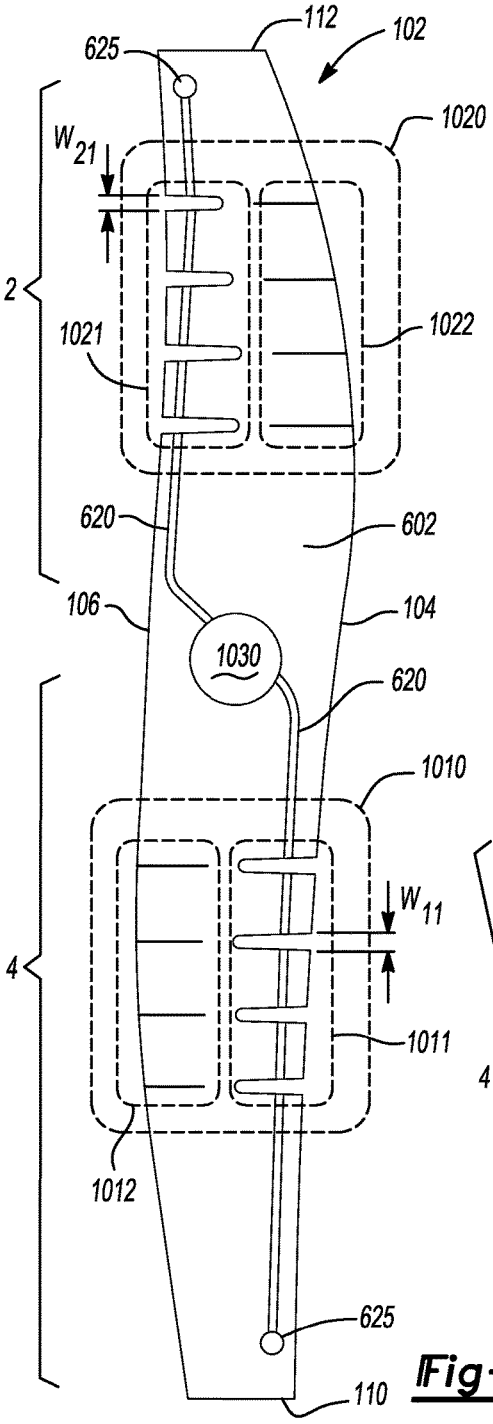
FIG. 10 is a front view of a core of one of the shoulder straps of FIG. 1 having a straight configuration.
Figure 11:
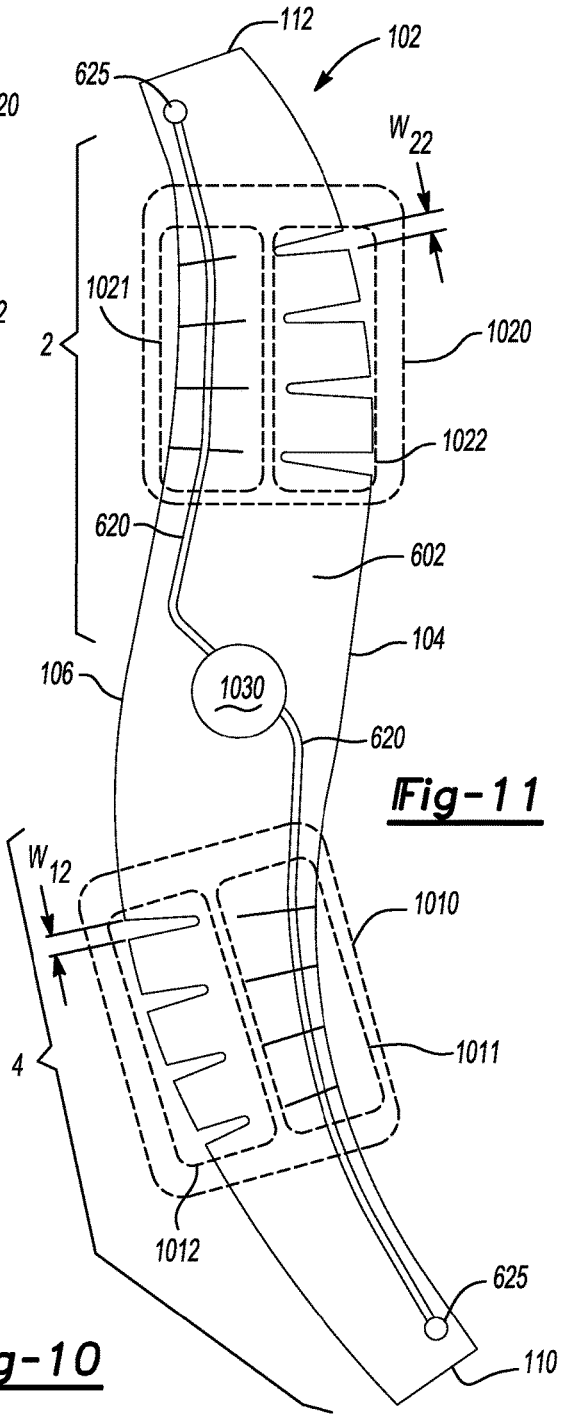
FIG. 11 is a front view of a core of one of the shoulder straps of FIG. 1 having a curved configuration when ends of the core are pulled by a tension element.

FIGS. 10 and 11 provide a front view of the core 602 of the first shoulder strap 100 with the tension element 120 and the actuation mechanism 130 removed when the core 602 is in the straight configuration (FIG. 10) and when the core 602 is in the curved or S-shaped configuration (FIG. 11). At the upper portion 2 of the core 602, the channel 620 may be disposed proximate to the outer edge 106 of the core 602 and may extend between the recess 625 disposed proximate to the second end 112 and a mounting location 1030 associated with a location for receiving and mounting the actuation mechanism 130. Similarly, the channel 620 at the lower portion 4 of the core 602 may be disposed proximate to the inner edge 104 of the core 602 and may extend between the recess 625 disposed proximate to the first end 110 and the mounting location 1030. The channel 625 may curve toward the mounting location 1030 from both the upper portion 2 and the lower portion 4 to allow the corresponding portions 121, 122 of the tension element 120, when disposed therein, to approach the mounting location 1030 from opposite directions.

In some implementations, the first series of gaps 1010 includes a first portion 1011 associated with gaps extending from the inner edge 104 of the core 602 toward the center of the core 602. Here, the channel 620 may traverse the first portion 1011 of the first series of gaps 1010 to allow the first portion 121 of the tension element 120, when received by the channel 620, to be placed in a position that traverses the first portion 1011 of the first series of gaps 1010. When the core 602 is relaxed, FIG. 10 shows each gap of the first portion 1011 having a respective width $W_{11}$ that separates segments of the core 602 located between adjacent gaps 1010. The gaps of the first portion 1011 may facilitate bending and flexing of the inner edge 104 toward the center of the core 602 when the foregoing first force $F_1$ (FIG. 9) is applied on the first end 110 of the core 602. For instance, FIG. 11 shows the width $W_{11}$ of the gaps of the first portion 1011 reducing and closing as the inner edge 104 flexes and bends toward the center of the core 602 to attain the curve at the lower portion 4 that contributes to the curved or S-shaped configuration.

The first series of gaps 1010 associated with the lower portion 4 may optionally include a second portion 1012 associated with gaps extending from the outer edge 106 of the core 602 toward the center of the core 602. The gaps of the second portion 1012 may oppose corresponding ones of the gaps of the first portion 1011. In contrast to the gaps of the first portion 1011, the gaps of the second portion 1012 are not traversed by the channel 620 and may facilitate the releasing of the bent and flexed outer edge 106 when the applied first force $F_1$ (FIG. 9) on the first end 110 of the core 602 is released. For example, when the first end 110 of the core 602 is pulled toward the second end 112, FIG. 11 shows each gap of the second portion 1012 as having a respective width $W_{12}$ that separates segments of the core 602 located between adjacent gaps of the second portion 1012. However, when the applied force on the first end 110 is released, FIG. 10 shows the width $W_{12}$ of the gaps of the second portion 1012 reducing and closing as the flexed and bent outer edge 106 straightens to attain the straight configuration at the lower portion 4.

As with the first series of gaps 1010, the second series of gaps 1020 associated with the upper portion 2 may include a first portion 1021 associated with gaps extending from the outer edge 106 of the core 602 toward the center of the core 602. The channel 620 may traverse the first portion 1021 of the second series of gaps 1020 to allow the second portion 122 of the tension element 120, when received by the channel 620, to be placed in a position that traverses the first portion 1021 of the second series of gaps 1020. When the core 602 is relaxed, FIG. 10 shows each gap of the first portion 1021 having a respective width $W_{21}$ that separates segments of the core 602 located between adjacent gaps 1020. In contrast to the first series of gaps 1010 of the first portion 1011 facilitating bending and flexing of the outer edge 106 in a direction away from the center of the core 602, the gaps 1020 of the first portion 1021 may facilitate bending and flexing of the outer edge 106 in the opposite direction toward the center of the core 602 when the foregoing second force $F_2$ (FIG. 9) is applied on the second end 112 of the core 602. For instance, FIG. 11 shows the width $W_{21}$ of the gaps of the first portion 1021 reducing and closing as the outer edge 104 flexes and bends toward the center of the core 602 to attain the curve at the upper portion 2 that contributes to the curved or S-shaped configuration.

The second series of gaps 1020 associated with the upper portion 2 may optionally include a second portion 1022 associated with gaps extending from the inner edge 104 of the core 602 toward the center of the core 602. The gaps of the second portion 1022 may oppose corresponding ones of the gaps of the first portion 1021. In contrast to the gaps 1020 of the first portion 1021, the gaps 1010 of the second portion 1012 are not traversed by the channel 620 and may facilitate the releasing of the bent and flexed inner edge 104 when the applied second force $F_2$ (FIG. 9) on the second end 112 of the core 602 is released. For example, when the second end 112 of the core 602 is pulled toward the first end 110, FIG. 11 shows each gap of the second portion 1022 having a respective width $W_{22}$ that separates segments of the core 602 located between adjacent gaps of the second portion 1022. However, when the force applied on the second end 112 of the core 602 is released, FIG. 10 shows the width $W_{22}$ of the gaps of the second portion 1012 reducing and closing as the flexed and bent inner edge 104 straightens to attain the straight configuration at the upper portion 2.

In some implementations, the widths $W_{11}$, $W_{12}$, $W_{21}$, $W_{22}$ associated at least one of the series of gaps 1010, 1020 may decrease from its respective edge 104, 106 of the core 602 toward the center of the core 602. In some examples, the first portion 1011 of the first series of gaps 1010 and the first portion 1021 of the second series of gaps 1020 each include gaps that reduce when the tension element 120 is moved from the relaxed state (e.g., FIG. 10) to the tightened state (e.g., FIG. 11). Conversely, the second portion 1012 of the first series of gaps 1010 and the second portion 1022 of the second series of gaps 1020 each include gaps that reduce when the tension element 120 is moved from the tightened state to the relaxed state. Accordingly, the first series of gaps 1010 and the second series of gaps 1020 may be disposed on opposite ends of the core 602 to permit the core 602 to flex, bend, or otherwise change its shape, when the tension element 130 is moved from the relaxed state to the tightened state. For instance, the core 602 may flex to change its shape to the curved or S-shaped configuration based on the location of the gaps 1010, 1020 and the placement of the portions 121, 122 of the tension element 120 disposed along the length of the core 602 and received by the channel 620 formed therein.

FIG. 12 provides a schematic view of the actuation mechanism 130 that selectively retracts (e.g., tightens) or releases (e.g., untightens) the first portion 121 and the second portion 122 of the tension element 120. The actuation mechanism 130 may include a housing 136 and the knob 134 rotatably mounted to the housing 136 via a shaft 138. As described above, the knob 134 may be manipulated to retract the portions 121, 122 of the tension element 120 received by the actuation mechanism 130. For example, rotating the knob 134 in the clockwise direction 132 relative to the view shown in FIG. 9 may retract the portions 121, 122 and thereby tension the portions 121, 122 to reduce slack in the tension element 120. In other configurations, a lever or crank may be incorporated in lieu of the knob 134 to retract the portions 121, 122 of the tension element 120.

The distal ends 125, 126 of the portions 121, 122 may be attached to a spool 137 or reel having a common axis of rotation with the shaft 138. Likewise, ends of the corresponding guide members 127, 128 may be attached to the housing 135 and/or may be secured to at least one of the core 602 and the core cover 603. The spool 137 or reel may wind the portions 121, 122 of the tension element 120 when the knob 134 is rotated in the clockwise direction 132 relative to the view shown in FIG. 9 to retract the portions 121, 122 and reduce slack in the tension element 120. In some examples, the spool 137 includes a single-groove spool. However, a dual-groove spool or two, side-by-side spools may advantageously permit convenient simultaneous retraction of both portions 121, 122 of the tension element 120. FIG. 12 shows the portions 121, 122 of the tension element 120 approaching the spool 137 from opposite directions to permit the portions 121, 122 to wrap around the spool 137 in opposite directions using the rotatable shaft 138 that rotatably mounts the knob 134 to the housing 136 when the knob 134 is rotated relative to the core 602.

The actuation mechanism 130 may also include a ratchet mechanism 140 having a common axis of rotation with the shaft 138. The ratchet mechanism 140 may include a plurality of sloped teeth 142 positioned circumferentially around the axis of the ratchet mechanism 140 that mate with a locking mechanism 144 to retain a predetermined length of the portions 121, 122, of the tension element 120 as the knob 134 is rotated relative to the core 602. The locking mechanism 144 may be disposed within an aperture of the housing 136 and a biasing member 146 may bias the locking mechanism 144 into locked engagement with the sloped teeth 142 of the ratchet mechanism 140. Thus, in a first mode of operation, the locking mechanism 144 inhibits counterclockwise rotation of the knob 134 and loosening of the first and second portions 121, 122, respectively, of the tension element 120. However, the sloped teeth 142 do not inhibit rotation of the knob 134 in the clockwise direction 132 because the locking mechanism 144 is allowed to slide over the teeth 142. Thus, when the knob 134 is rotated in the clockwise direction 132 relative to the view shown in FIG. 12, the locking mechanism 144 automatically engages the teeth 142 to allow the user to incrementally adjust the amount of the portions 121, 122 that are drawn into the actuation mechanism 130.

In some implementations, the actuation mechanism 130 includes a release member 148 in communication with the locking mechanism 144 and fixed for movement with the knob 134. The release member 148 may selectively overcome the biasing of the locking mechanism 144 to disengage the locking mechanism 144 from the sloped teeth 142 of the ratchet mechanism 140. For example, the release member 148 may be coupled for common rotation with the shaft 138 and may selectively slide along the longitudinal axis of the shaft 138 to move the locking mechanism 144 out of engagement with the teeth 142. In this configuration, the knob 134 may be moved in a direction away from the ratchet mechanism 140 to disengage the locking mechanism 144 from the teeth 142 of the ratchet mechanism 140. Disengaging the locking mechanism 144 from the teeth 142 of the ratchet mechanism 140 allows the knob 134 and, thus, the spool 137, to rotate in the counterclockwise direction relative to the view shown in FIG. 12. Allowing the spool 137 to rotate in the counterclockwise direction relative to the view shown in FIG. 12 allows the portions 121, 122 of the tension element 120 to be drawn from the actuation mechanism 130 such than an effective length of each portion 121, 122 is increased. Increasing the effective length of each portion 121, 122 allows the core 612 and, thus, the main body 102, to move from a curved configuration (FIG. 9) toward the straight configuration (FIG. 6) as the forces $F_1$, $F_2$ applied to the ends 110, 112 of the main body 102 are released. The resilient nature of the material of the core 602 may automatically cause the main body 102 to assume the straight configuration. Alternatively or additionally, a force may be applied at one or both ends 110, 112 of the main body 102 to move the main body 102 into the straight configuration.

Thus far, the first shoulder strap 100 and the second shoulder strap 200 are described and shown as being associated with a golf bag 10. However, the first shoulder strap 100 and the second shoulder strap 200 could be used with any bag. For example, and with particular reference to FIGS. 13-16, similar straps 100*a*, 200*a* could be used in conjunction with a carry bag 10*a* such as a backpack. As with the straps 100, 200 of the golf bag 10, the straps 100*a*, 200*a* of the carry bag 10*a* may be moved between a substantially straight configuration and a curved configuration by manipulating a respective actuation mechanism 130, 230.

The carry bag 10*a* of FIGS. 13-16 includes a body 16*a* having interior surfaces that define an interior void 18*a* that receives and holds items. In view of the substantial similarity in structure and function of the components associated with the golf bag 10 with respect to the carry bag 10*a*, like reference numerals are used hereinafter and in the drawings to identify like components while like reference numerals containing letter extensions are used to identify those components that have been modified.

The carry bag 10*a* may include one or more shoulder straps 100*a*, 200*a* attached to the body 16*a* via the one or more fastening straps 38*a*. The shoulder straps 100*a*, 200*a* support the carry bag 10*a* on shoulders of a user so that the user can transport the carry bag 10*a* in the same manner as a conventional backpack. The first shoulder strap 100*a* may include a main body 102*a* having a first end 110 attached to a first attachment location 160*a* of the carry bag 10*a* and a second end 112 attached to a second attachment location 162*a* of the carry bag 10*a*. Likewise, the second shoulder strap 200*a* may include a main body 202*a* having a first end 210 attached to a third attachment location 170*a* of the carry bag 10*a* and a second end 212 attached to a fourth attachment location 172*a* of the carry bag 10*a*.

Figure 13:
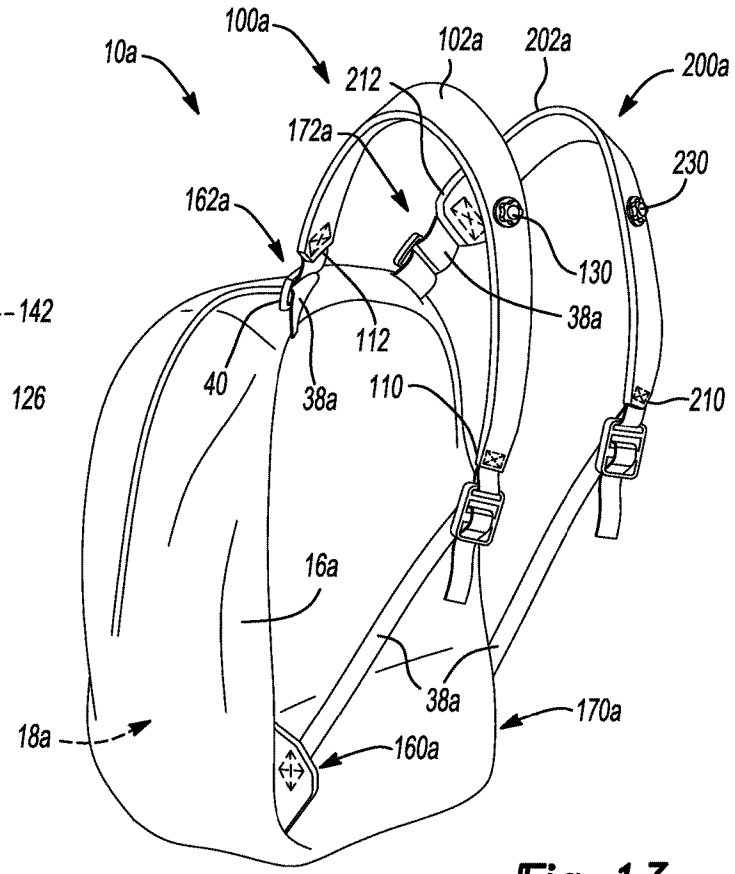
FIG. 13 is a perspective view of a carry bag having dual shoulder straps in accordance with principles of the present disclosure.
Figure 14:
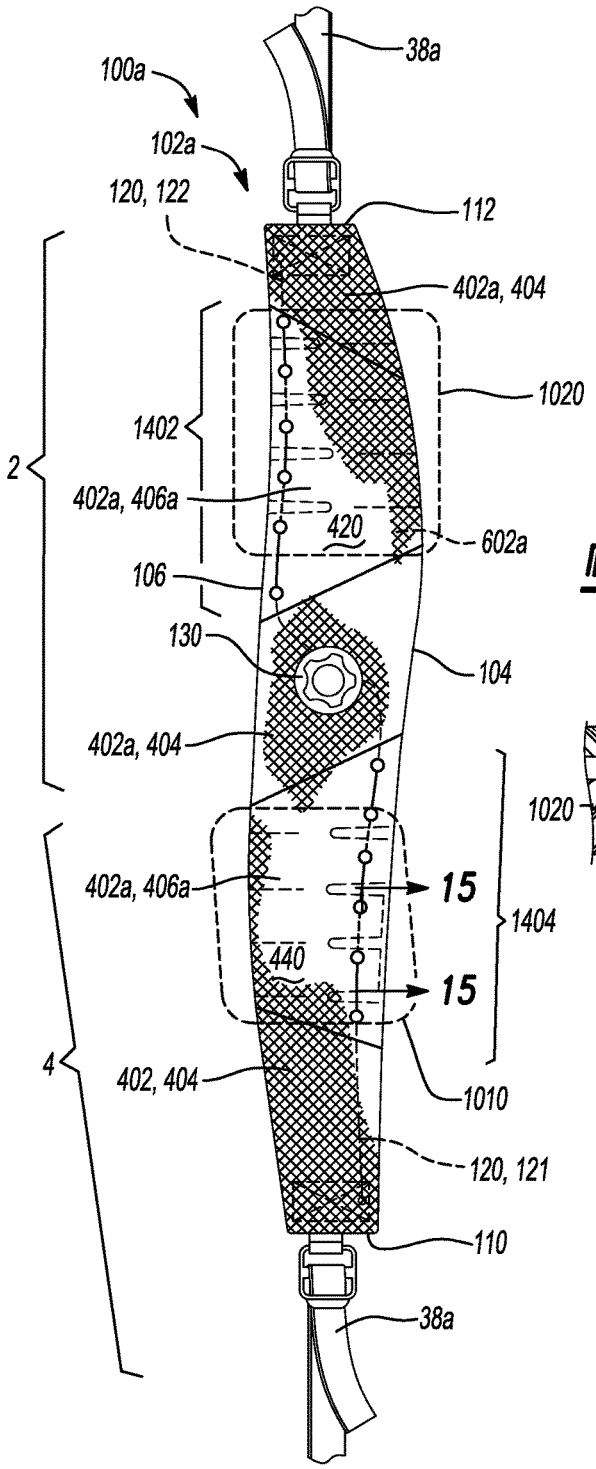
FIG. 14 is a front view of one of the shoulder straps of FIG. 13 having a straight configuration.
Figure 16:
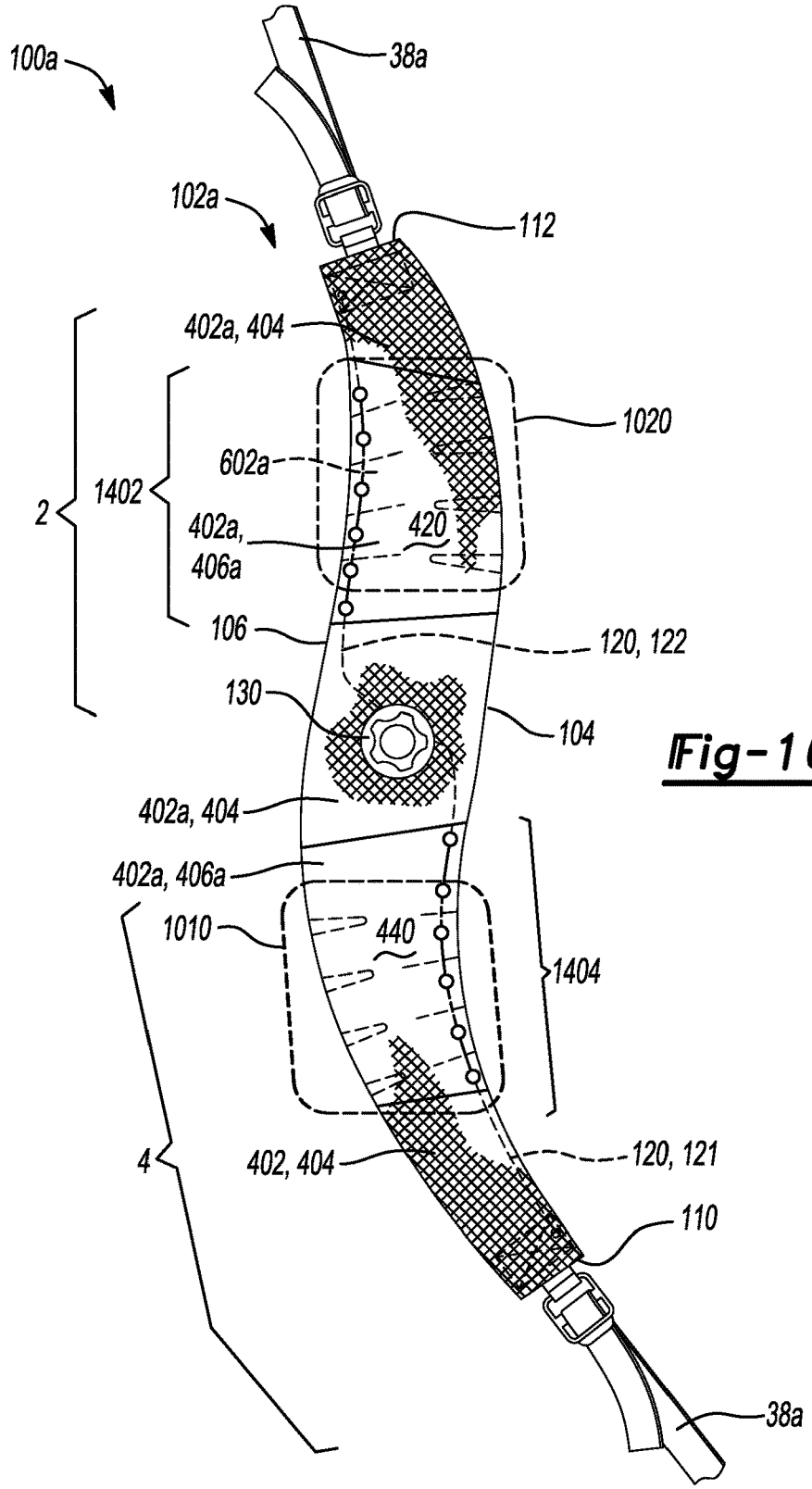
FIG. 16 is a front view of one of the shoulder straps of FIG. 13 having a curved configuration.

FIGS. 14 and 16 provide a front view of the first shoulder strap 100*a* (e.g., right shoulder strap) of FIG. 13 illustrating the straight configuration (FIG. 14) when the tension element 120 is in the relaxed state and having the curved or S-shaped configuration (FIG. 16) when the tension element 120 is in the tightened state. The straps 100*a*, 200*a* are mirror images of one another but are otherwise identical. Accordingly, a detailed description of the second shoulder strap 200*a* and associated actuation mechanism 230 is foregone.

The main body 102*a* defines a length extending between the ends 110, 112 and includes the inner edge 104 and the outer edge 106 extending between ends 110, 112 to define the perimeter of the main body 102*a*. The main body 102*a* may include a core 602*a* extending along the length of the main body to provide a degree of cushioning for the corresponding shoulder under the load applied by the carry bag 10*a*. As with the main body 102 of the strap 100 associated with the golf bag 10, the main body 102*a* of the strap 100*a* associated with the carry bag 10*a* may change its shape when the tension element 120 moves between the relaxed state and the tightened state. For instance, FIG. 16 shows the main body 102*a* changing its shape from the straight configuration to the curved or S-shaped configuration when the first portion 121 of the tension element 120 pulls the first end 110 of the main body 102*a* toward the actuation mechanism 130 and when the second portion 122 of the tension element 120 simultaneously pulls the second end 112 of the main body 102*a* toward the actuation mechanism 130.

The main body 102*a* may also include a cover 402*a* that covers and is secured to the front surface of the core 602*a*. As with the cover 402 of the strap 100, the cover 402*a* includes a flexible portion 406*a* disposed within each of the flexion regions 420, 440 and a durable/rigid portion 404 disposed adjacent to each of the ends 110, 112 of the main body 102*a* and also between the flexion regions 420*a*, 440 proximate to the actuation mechanism 130.

While the shoulder strap 100 for the golf bag 10 of FIGS. 1-11 provides the channel 620 disposed along the length of its main body 102 to facilitate slidability of the portions 121, 122 and to prevent the portions 121, 122 from laterally moving out of position relative to the core 602*a*, the shoulder strap 100*a* of the carry bag 10*a* instead provides at least one series of holes 1402, 1404 formed through the flexible portion 406*a* of the cover 402 and disposed along a portion of the length of the main body 102*a*. The at least one series of holes 1402, 1404 may include eyelets and/or other engagement features such as fabric or mesh loops that receive corresponding ones of the portions 121, 122 of the tension element 120, thereby preventing the portions 121, 122 from laterally moving out of position.

For example, a lower series of holes 1404 associated with the lower portion 4 of the main body 102*a* may retain the first portion 121 of the tension element in a position that traverses the first series of gaps 1010 that extend along the inner edge 104 and an upper series of holes 1402 associated with the upper portion 2 of the main body 102*a* may retain the second portion 122 of the tension element 120 in a position that traverses the second series of gaps 1020 that extend along the outer edge 106. The upper series of holes 1402 may be formed through the flexible portions 406*a* of cover 402*a* at the upper flexion region 420 while the lower series of holes 1404 may be formed through the flexible portion 406*a* at the lower flexion region 440. In this example, the lower series of holes 1402 may extend along the inner edge 104 while the upper series of holes 1402 may extend along the outer edge 106. The holes 1402, 1404 allow the tension element 120 to be threaded through the cover 402 to maintain a relative position of the first portion 121 of the tension element 120 and the inner edge 104 and a relative position of the second portion 122 of the tension element 120 and the outer edge 106. Threading the tension element 120 through the cover 402 results in a portion of the tension element 120 being exposed at an outer surface of the cover 402 and a portion of the tension element 120 being disposed between the cover 402 and the core 602*a*, as shown in FIG. 15.

Figure 15:
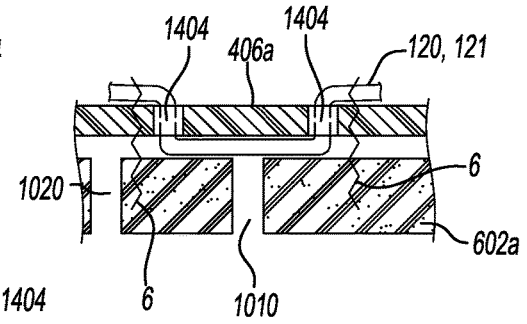
FIG. 15 is a cross-sectional view taken along line 15-15 of FIG. 14 showing a series of holes formed through a cover of the shoulder strap and receiving a portion of a tension element.

FIG. 15 provides a cross-sectional view taken along line 15-15 of FIG. 14 showing the series of holes 1402 formed through the flexible portion 406*a* of the cover 402*a* and receiving the first portion 121 of the tension element 120. For example, the first portion 121 of the tension element 120 may weave through the series of holes 1404 so that the tension element 120 includes segments extending along its length that alternate between extending outside of the cover 402*a* and extending between the cover 402*a* and the core 602*a*. Thus, by permitting the first portion 121 of the tension element 120 to extend into and out of the cover 402*a* through the series of holes 1402, the first portion 121 may maintain its position relative to and traversing the first series of gaps 1010. The second portion 122 of the tension element 120 may similarly weave through the upper series of holes 1402 formed through the flexible portion 406*a* of the cover 402*a* at the upper flexion region 420. Additionally, the cover 402*a* and the portions 121, 122 of the tension element 120 may be secured to the core 602*a* via stitching 6 at the segments of the core 602*a* between adjacent gaps of the first series of gaps 1010 and the second series of gaps 1020.

In some examples, the holes of at least one of the series of holes 1402, 1404 are lined or coated with a low-friction material, such as a lubricous polymer, that facilitates movement of the portions 121, 122 of the tension element 120 relative to each hole 1402, 1404. In some examples, the holes 1402, 1404 may include a suitable substantially rigid material that is coated with a lubricous coating to further facilitate movement of the portions 121, 122 relative to the holes 1402, 1404, as the tension element 120 is moved relative to the core 602*a* by the actuation mechanism 130. The substantially rigid material may impart rigidity to the holes 1402, 1404 to prevent bending and kinking of the holes 1402, 1404 and/or the portions 121, 122 of the tension element 120 extending therethrough when the portions 121, 122 are tightened by the actuation mechanism 130.

While the straps 100, 200 are described and shown in conjunction with a golf bag 10 and the straps 100*a*, 200*a* are described and shown in conjunction with a carry bag 10*a*, the straps 100, 200 could be used in conjunction with the carry bag 10*a* and the straps 100*a*, 200*a* could be used in conjunction with the golf bag 10*a*.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A strap for a bag, the strap comprising:

a main body having a first end attached to a first attachment location of the bag, a second end attached to a second attachment location of the bag, a first edge extending along a length of the main body between the first end and the second end, and a second edge extending along a length of the main body between the first end and the second end, the second edge being disposed on an opposite side of the main body than the first edge, the first end being disposed closer to one of the first edge and the second edge than the other of the first edge and the second edge, and the second end being disposed closer to the other of the first edge and the second edge than the one of the first edge and the second edge;

a tension element extending along a majority of the main body between the first end and the second end, movable between a tightened state and a relaxed state, and including a first portion attached to the first end and a second portion attached to the second end, the tension element applying a force on the first end and the second end in the tightened state to change the relative position of the first end and the second end; and an actuation mechanism rotatably supported by the main body and operable to move the tension element between the tightened state and the relaxed state, the actuation mechanism simultaneously collecting the first portion and the second portion when moving the tension element from the relaxed state to the tightened state.

2. The strap of claim 1, wherein changing the relative position between the first end and the second end includes changing a shape of the main body.

3. The strap of claim 1, wherein the actuation mechanism includes a locking mechanism operable to maintain the tension element in the tightened state in a first mode of operation and is operable to maintain the tension element in the relaxed state in a second mode of operation.

4. The strap of claim 1, wherein the main body includes a series of gaps disposed along a length of the main body, the gaps permitting the main body to flex when the tension element is moved from the relaxed state to the tightened state.

5. The strap of claim 4, wherein the gaps include a decreasing width in a direction extending from at least one of an inner edge and an outer edge of the main body toward a center of the main body.

6. The strap of claim 4, wherein the tension element traverses the gaps between the first end and the second end.

7. The strap of claim 4, wherein the gaps are reduced when the tension element is moved from the relaxed state to the tightened state.

8. The strap of claim 1, wherein the main body includes at least one area of increased flexibility to allow the main body to take a different shape when the tension element is moved between the tightened state and the relaxed state.

9. A strap for a bag, the strap comprising:

a main body having a first end attached to a first attachment location of the bag, a second end attached to a second attachment location of the bag, a first edge extending along a length of the main body between the first end and the second end, and a second edge extending along a length of the main body between the first end and the second end, the second edge being disposed on an opposite side of the main body than the first edge, the first end being disposed closer to one of the first edge and the second edge than the other of the first edge and the second edge, and the second end being disposed closer to the other of the first edge and the second edge than the one of the first edge and the second edge;

a tension element extending along a majority of the main body between the first end and the second end, movable between a tightened state and a relaxed state, and including a first portion attached to the first end and a second portion attached to the second end, the tension element applying a force on the first end and the second end in the tightened state to change the relative position of the first end and the second end; and an actuation mechanism disposed between the first end and the second end and operable to move the tension element between the tightened state and the relaxed state, the actuation mechanism simultaneously collecting the first portion and the second portion when moving the tension element from the relaxed state to the tightened state.

10. The strap of claim 9, wherein changing the relative position between the first end and the second end includes changing a shape of the main body.

11. The strap of claim 9, wherein the actuation mechanism includes a locking mechanism operable to maintain the tension element in the tightened state in a first mode of operation and is operable to maintain the tension element in the relaxed state in a second mode of operation.

12. The strap of claim 9, wherein the main body includes a series of gaps disposed along a length of the main body, the gaps permitting the main body to flex when the tension element is moved from the relaxed state to the tightened state.

13. The strap of claim 12, wherein the gaps include a decreasing width in a direction extending from at least one of an inner edge and an outer edge of the main body toward a center of the main body.

14. The strap of claim 12, wherein the tension element traverses the gaps between the first end and the second end.

15. The strap of claim 12, wherein the gaps are reduced when the tension element is moved from the relaxed state to the tightened state.

16. The strap of claim 9, wherein the main body includes at least one area of increased flexibility to allow the main body to take a different shape when the tension element is moved between the tightened state and the relaxed state.

17. The strap of claim 9, wherein the actuation mechanism is positioned substantially equidistant from the first end and the second end.

18. The strap of claim 9, wherein the first portion and the second portion are collected by a common spool when the tension element is moved into the tightened state.

19. The strap of claim 1, wherein the actuation mechanism is positioned substantially equidistant from the first end and the second end.

20. The strap of claim 1, wherein the first portion and the second portion are collected by a common spool when the tension element is moved into the tightened state.

21. The strap of claim 1, wherein the actuation mechanism simultaneously collects the first portion and the second portion about a common axis when moving the tension element from the relaxed state to the tightened state.

22. The strap of claim 9, wherein the actuation mechanism simultaneously collects the first portion and the second portion about a common axis when moving the tension element from the relaxed state to the tightened state.

* * * * *